United States Patent [19]

Karlsen

[11] 4,361,072

[45] Nov. 30, 1982

[54] AUTOMATIC HAND FIREARM

[76] Inventor: Tore Karlsen, P.O. Box 78, 2280 Gjesåsen, Norway

[21] Appl. No.: 180,908

[22] Filed: Aug. 25, 1980

[30] Foreign Application Priority Data

Aug. 27, 1979 [NO] Norway ..... 792770

[51] Int. Cl.[3] ..... F41D 11/02

[52] U.S. Cl. ..... 89/154; 42/69 B

[58] Field of Search ..... 42/69 B; 89/154, 199

[56] References Cited

U.S. PATENT DOCUMENTS 580,923 4/1897 Browning ..... 89/154

1,227,668 5/1917 Reising ..... 89/199

3,483,648 12/1969 Speckhart ..... 42/69 B

FOREIGN PATENT DOCUMENTS 160771 6/1905 Fed. Rep. of Germany .

*Primary Examiner*—Stephen C. Bentley

*Attorney, Agent, or Firm*—Steinberg & Raskin

[57] ABSTRACT

The invention is related to an automatic hand firearm or pistol comprising the ordinary parts such as a frame, a barrel, a slide and a hammer, the movement of which parts all being obtained by one single driving spring also serving to brake the recoil movement of the slide and resulting in a soft and comfortable action in the weapon.

3 Claims, 6 Drawing Figures

AUTOMATIC HAND FIREARM

The application is related to an automatic hand firearm or pistol comprising a frame and a barrel mounted on the frame, a slide or bolt movable back and forth longitudinally of the barrel on the frame behind the barrel, a hammer which may be cocked and retained in a cocked position by means of a hammer pawl and which is designed to act on a firing pin provided in the slide movable in a suitable bore and spring means for the movement of the hammer and the slide relative to the frame.

The purpose of the invention is to provide a firearm of the kind described, which is reliable and has very few and sturdy parts. According to the invention this has been achieved in an atomatic hand firearm of the above described kind, wherein closing of the slide and the firing force of the hammer as well as the braking of the backward movement of the slide or bolt is caused by one single spring arranged in the frame.

It is a further characteristic feature of the invention that the hammer is transferring the spring force to act both for the braking of the bolt and for the advancing and closing of the slide against the chamber. Another feature of the invention consists in the bolt comprising a pivotably attached spring biased hammer pawl transferring the spring force from the hammer to the slide during the closing movement of the slide and maintaining the hammer in its cocked position in the firing state of the weapon. It is finally a characterizing feature of the invention that in the frame has been provided an adjustable screw acting as a bias for the main spring to regulate the trigger pull of the weapon, to adapt the weapon to different ammunition and to obtain a soft and comfortable recoiling action in the weapon.

Figure 1:
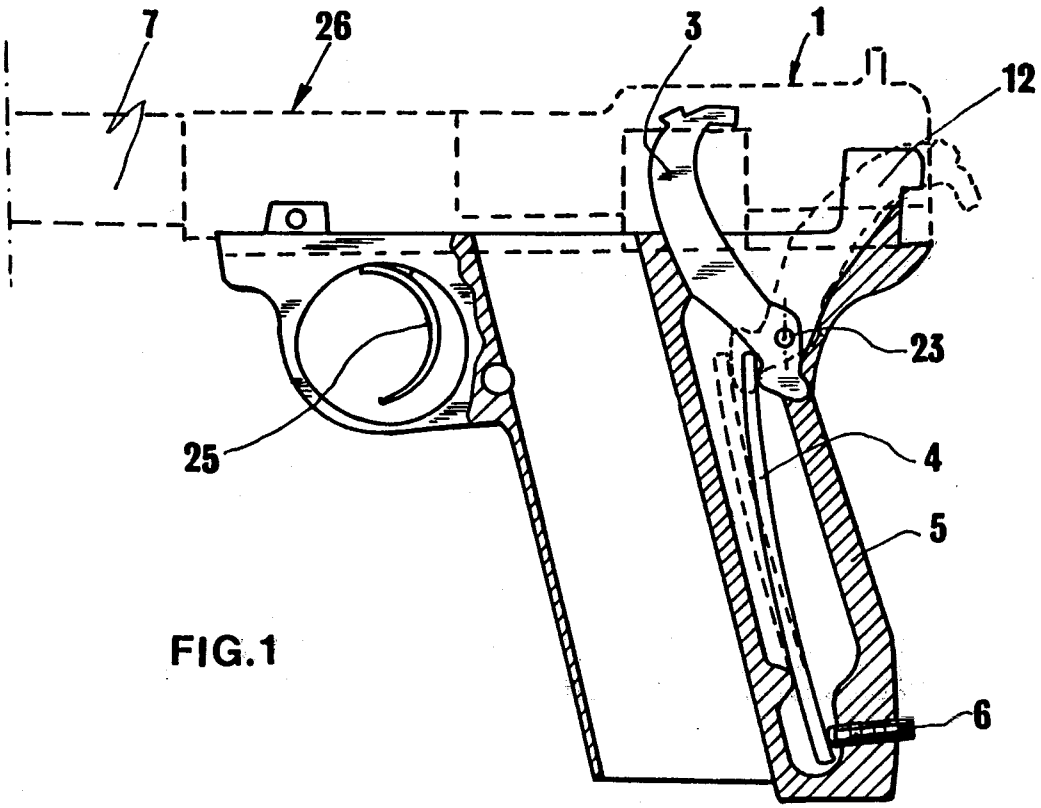
Figure 2A:
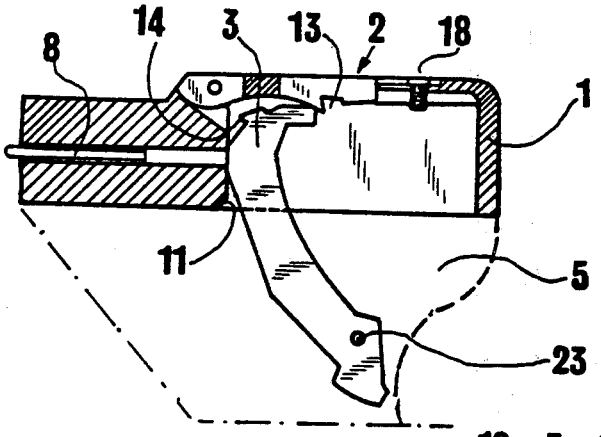
Figure 2B:
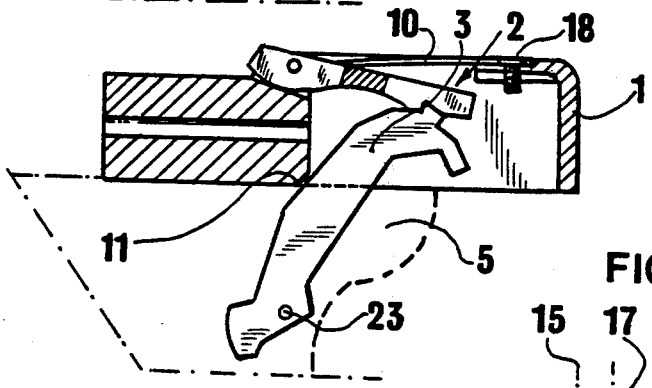
Figure 2C:
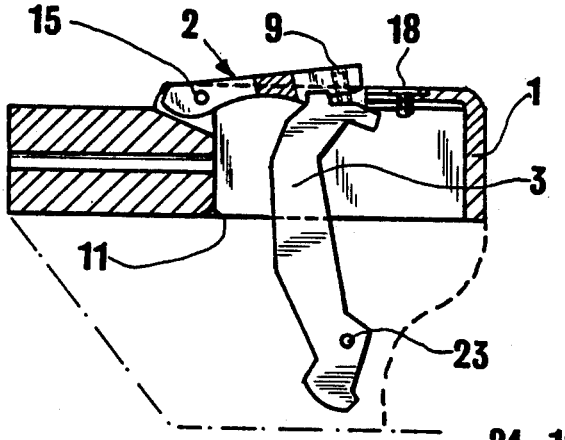
Figure 3:
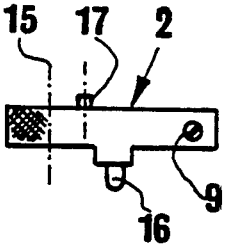
Figure 4:
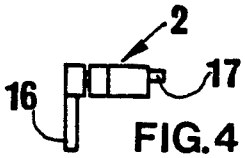
Figure 5:
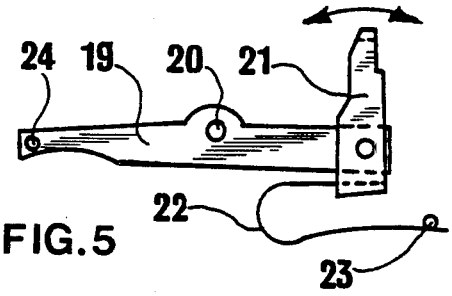
Figure 6:
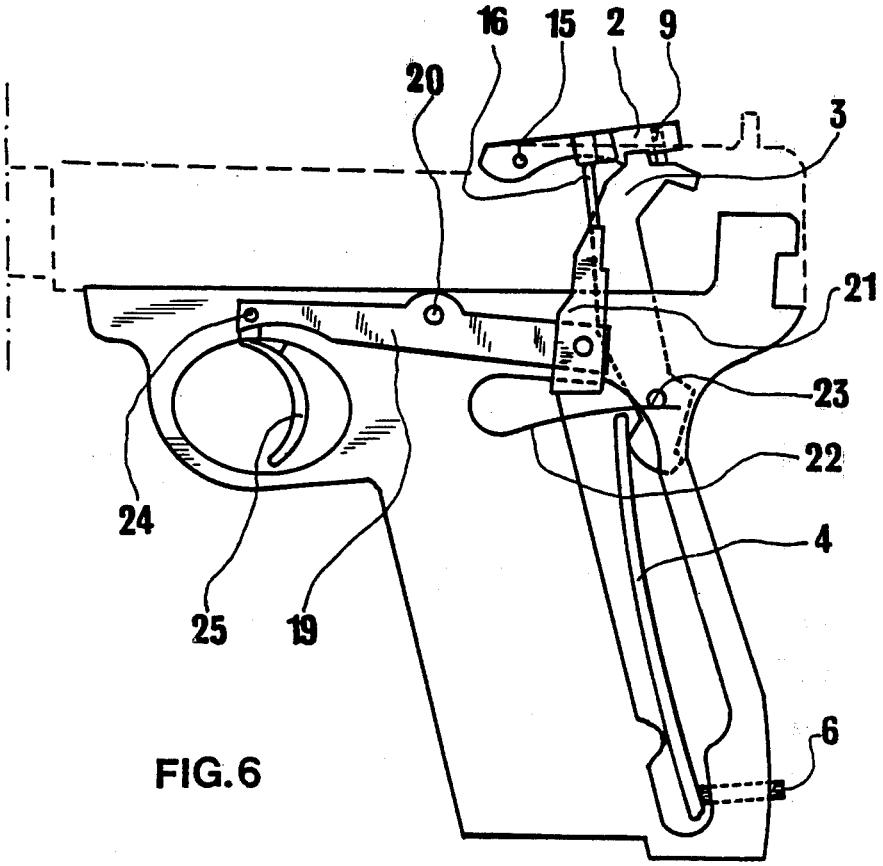

The invention will be better understood from the following description with reference to the attached drawings, wherein FIG. 1 is a part axial sectional view of the weapon frame showing the main spring mechanism, FIGS. *2a–c* are part sectional views showing the slide mechanism and hammer in three different positions, FIGS. 3–5 are showing parts of the mechanism as will be shown in assembled position on FIG. 6 and wherein FIG. 3 is showing the hammer pawl in a vertical view from above, FIG. 4 is showing the same part in an end view and FIG. 5 is showing the trigger arm transferring the trigger pull to the hammer pawl, and FIG. 6 is showing the function of the hammer and trigger mechanism.

The weapon according to the invention has the same substantial main parts as known firearms, i.e. a barrel 7, a cartridge chamber 26 in the extension of the barrel 7, a slide or bolt 1 movably arranged behind the chamber 26, a hammer 3 and a trigger mechanism 19–25. In the frame has been provided space for a magazine which shall not be further described because it is no part of the present invention. Furthermore, the frame is comprising a main spring 4 which through the medium of the hammer 3 is functioning as slide spring both by the braking of the recoil movement and for the advancing of the slide and this spring 4 is also serving as a firing spring for the hammer.

The hammer 3 is pivotably mounted on an axle 23 in the frame 5 and has a foot in engagement with the spring 4 and will tension the spring when the hammer is moved backwardly by the slide 1, i.e. towards the right in the drawing FIG. 1, the spring 4 during this recoil movement of the slide 1 simultaneously functioning as a brake and will prevent jolting of the hind end of the slide against the abutment 12 in the frame 5. By means of a screw 6 in the frame 5 the spring 4 may be adjusted in such a way that the spring force may be adjusted to various ammunition because such ammunition may vary very much according to the producers.

The function of the weapon now shall be described with reference to FIGS. *2a–c*. In the top surface of the slide has been inserted a hammer pawl 2 which is pivotable about an axle 15 in the upper portion of the slide 1 and biased inwardly of the slide (see FIG. *2b*) by means of a leaf spring 10 positioned in the top of the slide by means of a screw 18. The hammer pawl 2 has on its lower surface a groove 13 adapted to take up a corresponding lug 14 on the hammer when this is pivoting backwardly, i.e. towards the right in the drawing under the action of the slide recoil. When the uppermost portion of the hammer comprising the lug 14 is passing the hammer pawl 2 with the groove 13 the lug 14 will engage the groove 13 and the slide 1 will be braked by means of the spring 4 through the hammer 3.

From FIG. *2b* will be obvious that a rounded edge internally of the slide and designated 11 is carrying the hammer backwardly during the recoil movement. When the engagement between the lug 14 and the groove 13 (see FIG. *2b*) has been obtained and the slide is braked to a standstill by means of the spring 4, the movement will be reversed and the slide will be moving forwardly again while maintaining the engagement between the groove 13 of the hammer pawl and the lug 14 on the hammer. When the slide has advanced to its initial position (that means with closed cartridge chamber and a new cartridge in the chamber) the hammer 3 will be positioned as shown in FIG. *2c*, i.e. more particularly in a cocked position and ready for firing a new cartridge.

The trigger mechanism comprises a lever system 19–25 as shown in FIG. 6 and is functioning as follows, supposing the hammer in a cocked position and retained in this cocked position by means of the hammer pawl 2 as shown in FIG. *2c* and FIG. 6 and as described above. For the firing of a shot the lug 14 on the hammer 3 is released from the groove 13 in the hammer pawl 2 and this is obtained by lifting the hammer pawl and releasing the hammer which owing to the force of the spring 4 will strike against the firing pin 8 as shown in FIG. *2a*. When the shooter is pulling the trigger or sear 25 the forward end 24 of the trigger lever 19 will be pulled downwardly and the lever 19 is pivoting about its axle 20 (see also FIG. 5) so that the releasing arm 21 is lifted upwardly against the effect of a thin spring 22 having its one end attached in the release arm 21 and the other end beneath the axle 23 for the hammer 3. The release arm 21 is engaging a release pin 16 on the hammer pawl 2 as shown in FIGS. 3, 4 and 6 and is lifting the hammer pawl 2 releasing the hammer 3. When the trigger pull on the sear 25 is released the lever 19 will again pivot back to its initial position by the action of the spring 22.

The most important advantage obtained by the invention is that the firearm has no recoil spring and the hammer is functioning as a sort of slide spring both for the braking and the advance of the slide. In this way is obtained a soft and comfortable recoil and the hard jolts by the recoil known from ordinary weapons are avoided.

I claim:

1. An automatic hand firearm comprising:

a frame;

a barrel mounted on the frame;

a slide or bolt mounted on said frame rearwardly of said barrel for movement longitudinally with respect to said barrel, said slide having a bore formed therein in which a firing pin is movably located;

a hammer pivotally mounted in said frame adapted to pivotally move to a position wherein it impacts against the firing pin;

a spring member located in said frame having a portion acting against said hammer to continuously bias the latter toward the impacting position;

a hammer pawl member pivotally mounted on said slide or bolt in overlying relationship to said hammer, said pawl member including means for engaging said hammer;

means for biasing said pawl member in the direction of said hammer; and lever means for pivoting said hammer pawl member away from said hammer upon actuating a trigger member;

whereby said spring member exerts a force on the bolt or slide through said hammer and hammer pawl member which tends to brake said slide or bolt when it moves rearwardly under a recoiling action and which retains the hammer in a cocked position prior to firing of the weapon.

2. The combination recited in claim 1 wherein said means provided on said pawl member for engaging said hammer comprises a groove formed in said pawl member and wherein said hammer is provided with an upstanding lug adapted to be engaged by said groove.

3. The combination of claim 2 wherein said pawl member biasing means comprises a leaf spring fixed to said bolt or slide and having a portion bearing against said pawl member urging the same downwardly towards said hammer.

* * * * *